US008018424B2

(12) United States Patent
Tseng et al.

(10) Patent No.: US 8,018,424 B2
(45) Date of Patent: Sep. 13, 2011

(54) BACKLIGHT DEVICE WITH ZONE CONTROL

(75) Inventors: Shin-Chin Tseng, Taichung (TW); Shen-Hong Chou, Kaohsiung (TW); Fu-Cheng Wei, Jhubei (TW); Shien-Chih Ho, Jhubei (TW); Horng-Bin Hsu, Taipei (TW); Chung Peng, Taichung (TW)

(73) Assignee: Au Optronics Corporation, Hsinchu (TW)

( * ) Notice: Subject to any disclaimer, the term of this patent is extended or adjusted under 35 U.S.C. 154(b) by 723 days.

(21) Appl. No.: 11/583,455

(22) Filed: Oct. 19, 2006

(65) Prior Publication Data

US 2008/0094345 A1 Apr. 24, 2008

(51) Int. Cl.
*G09G 3/36* (2006.01)

(52) U.S. Cl. ..... 345/102

(58) Field of Classification Search ..... 345/102; 326/612

See application file for complete search history.

(56) References Cited

U.S. PATENT DOCUMENTS 5,931,555 A * 8/1999 Akahane et al. ..... 362/613
6,521,879 B1 2/2003 Rand et al.
6,529,182 B1 3/2003 Burton
6,841,947 B2 1/2005 Berg-Johansen
6,969,189 B2 11/2005 Lee et al.
6,995,518 B2 2/2006 Havlik et al.
7,387,421 B2 * 6/2008 Lee et al. ..... 362/612
2002/0159002 A1 10/2002 Chang
2005/0236970 A1 * 10/2005 Matsudate et al. ..... 313/500
2006/0239033 A1 * 10/2006 Jung et al. ..... 362/612

FOREIGN PATENT DOCUMENTS

CN 1545372 A 11/2004
TW 225958 B 1/2005

* cited by examiner

*Primary Examiner* — Chanh Nguyen
*Assistant Examiner* — Tsegaye Seyoum
(74) *Attorney, Agent, or Firm* — Morris Manning Martin LLP; Tim Tingkang Xia, Esq.

(57) ABSTRACT

A backlight unit usable in a liquid crystal display. In one embodiment, the backlight unit includes a substrate having an edge zone and a central zone surrounded by the edge zone, a first plurality of light emitting elements positioned in the central zone of the substrate, a second plurality of light emitting elements positioned in the edge zone of the substrate, and an electronic controlling means for controlling the light emitted from the first plurality of light emitting elements and the second plurality of light emitting elements such that in operation, the output power per unit area by the second plurality of light emitting elements in the edge zone is less than that by the first plurality of light emitting elements in the central zone.

10 Claims, 3 Drawing Sheets

BACKLIGHT DEVICE WITH ZONE CONTROL

FIELD OF THE INVENTION

The present invention relates generally to a backlight usable in a display device, and more particularly, to a light emitting diode (LED) backlight unit with zone control for use in a display device.

BACKGROUND OF THE INVENTION

Liquid crystal displays (LCDs) are commonly used as display devices for compact electronic apparatuses because of their capability of displaying images with good quality while using little power. However, the liquid crystals in an LCD do not emit any light themselves. The liquid crystals have to be lit up by a light source so as to clearly and sharply display text and images. Usually, a backlight device is employed as such a light source.

Typically, a backlight device comprises a plurality of light emitting diodes (LEDs), which are arranged in the form of a matrix. An LED can be characterized in general by physical characteristics such as luminous intensity, which can be used to describe the brightness of an LED and is represented by Iv in unit of mcd (millicandela), wavelength, which can be used to describe the color of an LED and is represented by Wd in unit of nm (nanometer), and positive voltage, which can be used to describe the operating range of an LED and is represented by Vf in unit of V. Luminous flux, in unit of lm (lumen), can also be used to describe the brightness of an LED. Ideally, if the plurality of light emitting diodes were identical to each other in terms of these physical characteristics, a corresponding backlight device would generate light with uniform brightness and desired colorfulness.

However, in reality, LEDs produced in industrial scale do not have same or identical physical characteristics; instead, they have a distribution for each of the characteristics. Table I shows specifications of a set of LEDs (2715 in total) that were produced by a manufacturer. As one can see from Table I, for examples, in Bin No. 3, there are four (4) LEDs that can emit red light, green light or blue light, where for a red light emitting LED, Iv is in the range of 596-625 mcd, Wd is in the range of 620-625 nm, and Vf is in the range of 2-2.2 V, for a green light emitting LED, Iv is in the range of 1,033-1,095 mcd, Wd is in the range of 525-530 nm, and Vf is in the range of 3.0-3.2 V, and for a blue light emitting LED, Iv is in the range of 186-200 mcd, Wd is in the range of 455-460 nm, and Vf is in the range of 3.2-3.4 V, respectively. In Bin No. 20, there are three hundred ninety-nine (399) LEDs that can emit red light, green light or blue light, where for a red light emitting LED, Iv is in the range of 596-625 mcd, Wd is in the range of 620-625 nm, and Vf is in the range of 2-2.2 V, for a green light emitting LED, Iv is in the range of 1,095-1,160 mcd, Wd is in the range of 525-530 nm, and Vf is in the range of 3.2-3.4 V, and for a blue light emitting LED, Iv is in the range of 186-200 mcd, Wd is in the range of 455-460 nm, and Vf is in the range of 3.0-3.2 V, respectively. Thus, LEDs as produced have an inherent distribution for each of the characteristics, which lead to undesired nonuniform distribution of brightness and/or colorfulness of an LCD display when the LEDs are utilized in a backlight unit for that LCD display.

Making LEDs having same or identical physical characteristics, even if it is possible, requires better materials and tougher quality control, among other things, which further increases the cost of the backlight unit.

Therefore, a heretofore unaddressed need exists in the art to address the aforementioned deficiencies and inadequacies.

SUMMARY OF THE INVENTION

The present invention, in one aspect, relates to a backlight unit usable in a liquid crystal display. In one embodiment, the backlight unit comprises a substrate having an edge zone and a central zone, where the central zone is surrounded by the edge zone; a first plurality of light emitting elements positioned in the central zone of the substrate, where the central zone comprises one or more segments, and each of the seg-

TABLE I

Specifications of a Set of LEDs
2220JT3-RGB-AUO12K(950425)

| | Red | | | Green | | | Blue | | | Output |
|---|---|---|---|---|---|---|---|---|---|---|
| Bin | Iv | Wd | Vf | Iv | Wd | Vf | Iv | Wd | Vf | Qty |
| 1 | | | | | | | | | | 0 |
| 2 | 596~625 | 620~625 | 2~2.2 | 1033~1095 | 525~530 | 3.0~3.2 | 186~200 | 455~460 | 3.0~3.2 | 1 |
| 3 | 596~625 | 620~625 | 2~2.2 | 1033~1095 | 525~530 | 3.0~3.2 | 186~200 | 455~460 | 3.2~3.4 | 4 |
| 4 | 596~625 | 620~625 | 2~2.2 | 1033~1095 | 525~530 | 3.0~3.2 | 200~216 | 455~460 | 3.0~3.2 | 0 |
| 5 | 596~625 | 620~625 | 2~2.2 | 1033~1095 | 525~530 | 3.0~3.2 | 200~216 | 455~460 | 3.2~3.4 | 3 |
| 6 | 596~625 | 620~625 | 2~2.2 | 1033~1095 | 525~530 | 3.0~3.2 | 216~233 | 455~460 | 3.0~3.2 | 0 |
| 7 | 596~625 | 620~625 | 2~2.2 | 1033~1095 | 525~530 | 3.0~3.2 | 216~233 | 455~460 | 3.2~3.4 | 1 |
| 8 | 596~625 | 620~625 | 2~2.2 | 1033~1095 | 525~530 | 3.2~3.4 | 186~200 | 455~460 | 3.0~3.2 | 158 |
| 9 | 596~625 | 620~625 | 2~2.2 | 1033~1095 | 525~530 | 3.2~3.4 | 186~200 | 455~460 | 3.2~3.4 | 400 |
| 10 | 596~625 | 620~625 | 2~2.2 | 1033~1095 | 525~530 | 3.2~3.4 | 200~216 | 455~460 | 3.0~3.2 | 45 |
| 11 | 596~625 | 620~625 | 2~2.2 | 1033~1095 | 525~530 | 3.2~3.4 | 200~216 | 455~460 | 3.2~3.4 | 399 |
| 12 | 596~625 | 620~625 | 2~2.2 | 1033~1095 | 525~530 | 3.2~3.4 | 216~233 | 455~460 | 3.0~3.2 | 0 |
| 13 | 596~625 | 620~625 | 2~2.2 | 1033~1095 | 525~530 | 3.2~3.4 | 216~233 | 455~460 | 3.2~3.4 | 31 |
| 14 | 596~625 | 620~625 | 2~2.2 | 1095~1160 | 525~530 | 3.0~3.2 | 186~200 | 455~460 | 3.0~3.2 | 3 |
| 15 | 596~625 | 620~625 | 2~2.2 | 1095~1160 | 525~530 | 3.0~3.2 | 186~200 | 455~460 | 3.2~3.4 | 2 |
| 16 | 596~625 | 620~625 | 2~2.2 | 1095~1160 | 525~530 | 3.0~3.2 | 200~216 | 455~460 | 3.0~3.2 | 4 |
| 17 | 596~625 | 620~625 | 2~2.2 | 1095~1160 | 525~530 | 3.0~3.2 | 200~216 | 455~460 | 3.2~3.4 | 9 |
| 18 | 596~625 | 620~625 | 2~2.2 | 1095~1160 | 525~530 | 3.0~3.2 | 216~233 | 455~460 | 3.0~3.2 | 0 |
| 19 | 596~625 | 620~625 | 2~2.2 | 1095~1160 | 525~530 | 3.0~3.2 | 216~233 | 455~460 | 3.2~3.4 | 2 |
| 20 | 596~625 | 620~625 | 2~2.2 | 1095~1160 | 525~530 | 3.2~3.4 | 186~200 | 455~460 | 3.0~3.2 | 399 |
| 21 | 596~625 | 620~625 | 2~2.2 | 1095~1160 | 525~530 | 3.2~3.4 | 186~200 | 455~460 | 3.2~3.4 | 454 |
| 22 | 596~625 | 620~625 | 2~2.2 | 1095~1160 | 525~530 | 3.2~3.4 | 200~216 | 455~460 | 3.0~3.2 | 171 |
| 23 | 596~625 | 620~625 | 2~2.2 | 1095~1160 | 525~530 | 3.2~3.4 | 200~216 | 455~460 | 3.2~3.4 | 563 |
| 24 | 596~625 | 620~625 | 2~2.2 | 1095~1160 | 525~530 | 3.2~3.4 | 216~233 | 455~460 | 3.0~3.2 | 66 |

ments of the central zone has at least one of the first plurality of light emitting elements; and a second plurality of light emitting elements positioned in the edge zone of the substrate, where the edge zone comprises one or more segments, and each of the segments of the edge zone has at least one of the second plurality of light emitting elements. The brightness degree of the second plurality of light emitting elements in the edge zone is less than the brightness degree of the first plurality of light emitting elements in the central zone.

Each of the first plurality of light emitting elements and the second plurality of light emitting elements has a corresponding area, where the corresponding area of each of the first plurality of light emitting elements is same as the corresponding area of each of the second plurality of light emitting elements. Each of the segments of the central zone and the segments of the edge zone has a corresponding surface area, where the corresponding surface area of each of the segments of the central zone is the same as the corresponding surface area of each of the segments of the edge zone.

In one embodiment, each of the first plurality of light emitting elements and the second plurality of light emitting elements comprises an LED chip capable of emitting light in a white color. In another embodiment, each of the first plurality of light emitting elements and the second plurality of light emitting elements comprises at least three LED chips, where the at least three LED chips comprise at least a first LED chip capable of emitting light in a red color, a second LED chip capable of emitting light in a green color, and a third LED chip capable of emitting light in a blue color. In one embodiment, each of the LED chips associated with the first plurality of light emitting elements in the central zone is characterized by a brightness degree $\{B_{kC}\}$, k=R, G, or B, corresponding to the red color light, the green color light, and the blue color light, respectively, and each of the LED chips associated with the second plurality of light emitting elements in the edge zone is characterized by a brightness degree $\{B_{kE}\}$, k=R, G, or B, corresponding to the red color light, the green color light, and the blue color light, respectively, and where at least one of the following relations is satisfied:

$$B_{RE}<B_{RC},\ B_{GE}<B_{GC},\ \text{and}\ B_{BE}<B_{BC}.$$

In another embodiment, each of the LED chips associated with the first plurality of light emitting elements in the central zone has a dimension characterized by an area $\{L_{kC}\}$, k=R, G, or B, corresponding to the red color light, the green color light, and the blue color light, respectively, and each of the LED chips associated with the second plurality of light emitting elements in the edge zone has a dimension characterized by an area $\{L_{kE}\}$, k=R, G, or B, corresponding to the red color light, the green color light, and the blue color light, respectively, and where at least one of the following relations is satisfied:

$$L_{RE}<L_{RC},\ L_{GE}<L_{GC},\ \text{and}\ L_{BE}<L_{BC}.$$

The first plurality of light emitting elements and the second plurality of light emitting elements have a corresponding area, respectively, and the corresponding area of the second plurality of light emitting elements in the edge zone is less than the corresponding area of the first plurality of light emitting elements in the central zone.

The backlight unit further comprises an electronic controlling means for controlling the light emitted from the first plurality of light emitting elements and the second plurality of light emitting elements, where the output power per unit area by the second plurality of light emitting elements in the edge zone is less than the output power per unit area by the first plurality of light emitting elements in the central zone. Specifically, in operation, the following relation is satisfied:

$$P_{RE}+P_{GE}+P_{BE}<P_{RC}+P_{GC}+P_{BC},$$

where $P_{RE}$, $P_{GE}$, $P_{BE}$, represent the output power per unit area corresponding to the red color light, the green color light, and the blue color light, respectively, of the second plurality of light emitting elements in the edge zone, and $P_{RC}$, $P_{GC}$, $P_{BC}$, represent the output power per unit area corresponding to the red color light, the green color light, and the blue color light, respectively, of the first plurality of light emitting elements in the central zone, respectively.

In another aspect, the present invention relates to a backlight unit usable in a liquid crystal display. In one embodiment, the backlight unit includes a substrate having at least a first zone and a second zone, where in operation the first zone has a temperature $T_H$, the second zone has a temperature $T_L$, and $T_H>T_L$. Furthermore, the backlight unit includes a first plurality of light emitting elements positioned in the first zone of the substrate, each of the first plurality of light emitting elements having at least a first LED chip capable of emitting light in a red color, a second LED chip capable of emitting light in a green color, and a third LED chip capable of emitting light in a blue color. Moreover, the backlight unit includes a second plurality of light emitting elements positioned in the second zone of the substrate, each of the second plurality of light emitting elements having at least a first LED chip capable of emitting light in a red color, a second LED chip capable of emitting light in a green color, and a third LED chip capable of emitting light in a blue color.

Furthermore, the backlight unit includes an electronic controlling means for controlling the light emitted from the first plurality of light emitting elements and the second plurality of light emitting elements such that in operation, the following relation is satisfied:

$$\frac{P_{RL}}{P_{RL}+P_{GL}+P_{BL}}<\frac{P_{RH}}{P_{RH}+P_{GH}+P_{BH}}$$

where $P_{RH}$, $P_{GH}$, $P_{BH}$, represent the output power per unit area corresponding to the red color light, the green color light, and the blue color light, respectively, of the first plurality of light emitting elements in the first zone having the temperature $T_H$, and $P_{RL}$, $P_{GL}$, $P_{BL}$, represent the output power per unit area corresponding to the red color light, the green color light, and the blue color light, respectively, of the second plurality of light emitting elements in the second zone having the temperature $T_L$, respectively.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
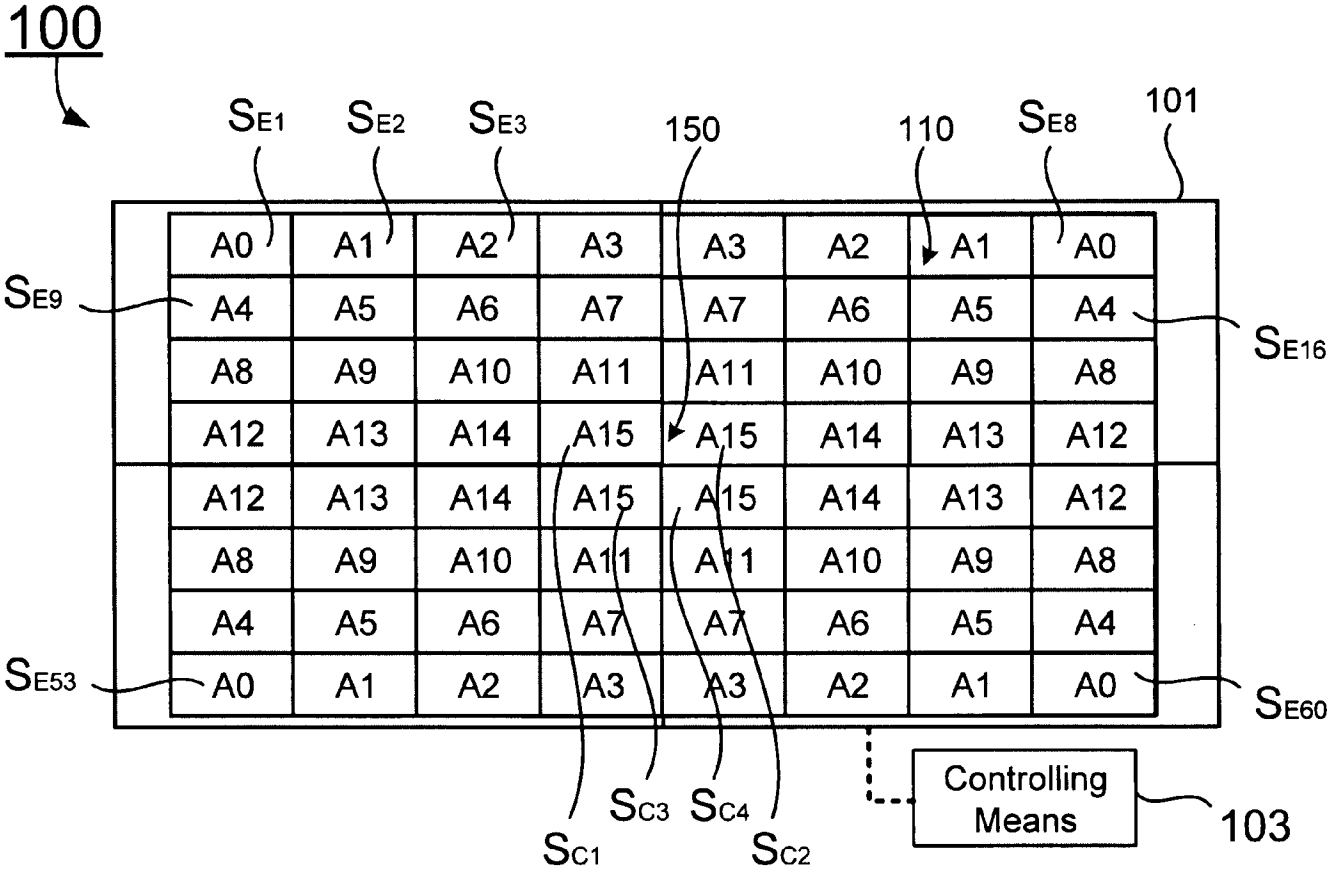
FIG. 1 partially shows schematically an LED backlight unit according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings in FIGS. 1-3. In accordance with the purposes of this invention, as embodied and broadly described herein, this invention, in one aspect, relates to a backlight unit usable in a liquid crystal display, which includes a substrate, a first plurality of light emitting elements and a second plurality of light emitting elements positioned in the substrate in different zones, and an electronic controlling means for controlling the light emitted from the first plurality of light emitting elements and the second plurality of light emitting elements according to the corresponding zones they are located.

Figure 2:
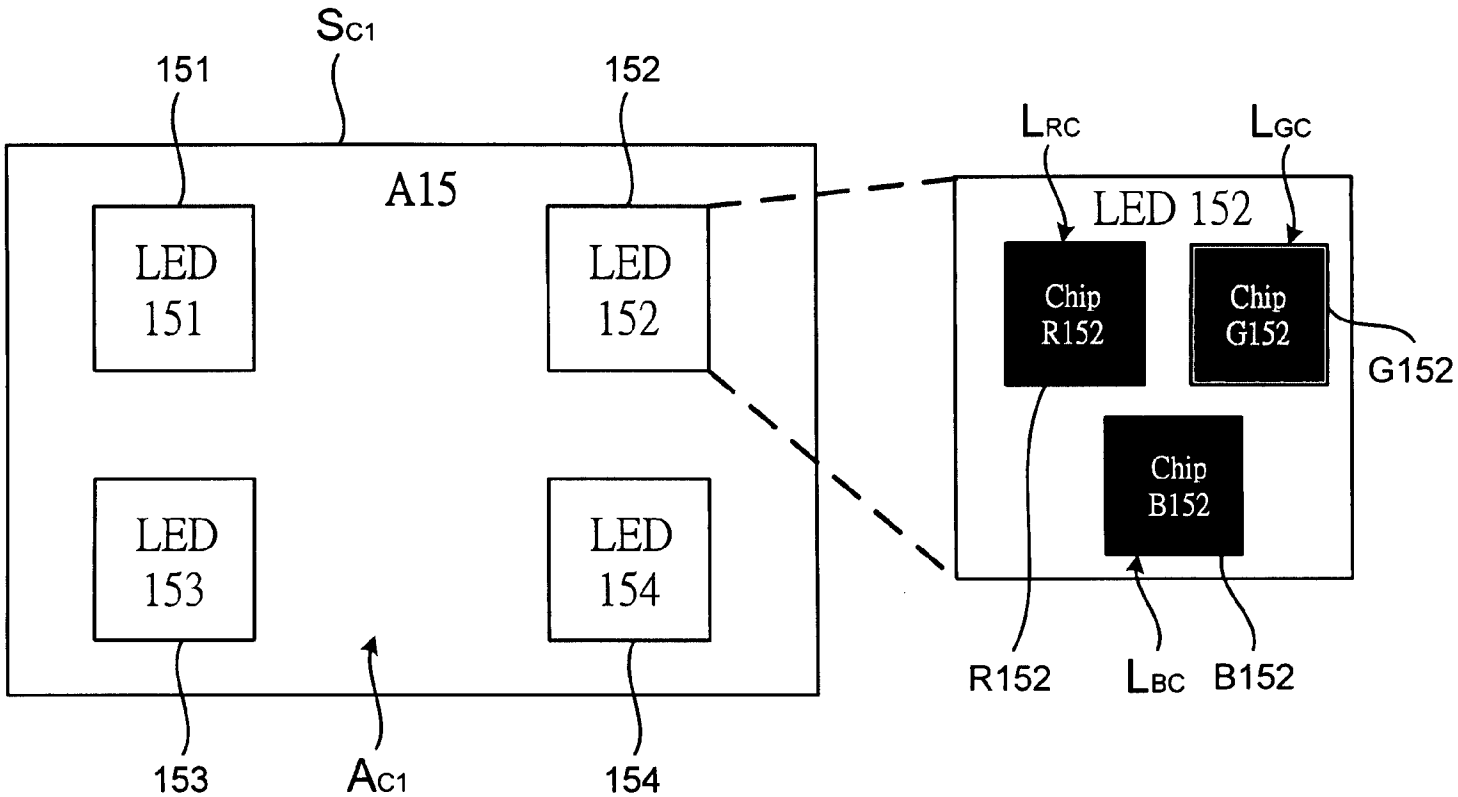
FIG. 2 shows schematically a central zone portion of the LED backlight unit shown in FIG. 1.
Figure 3:
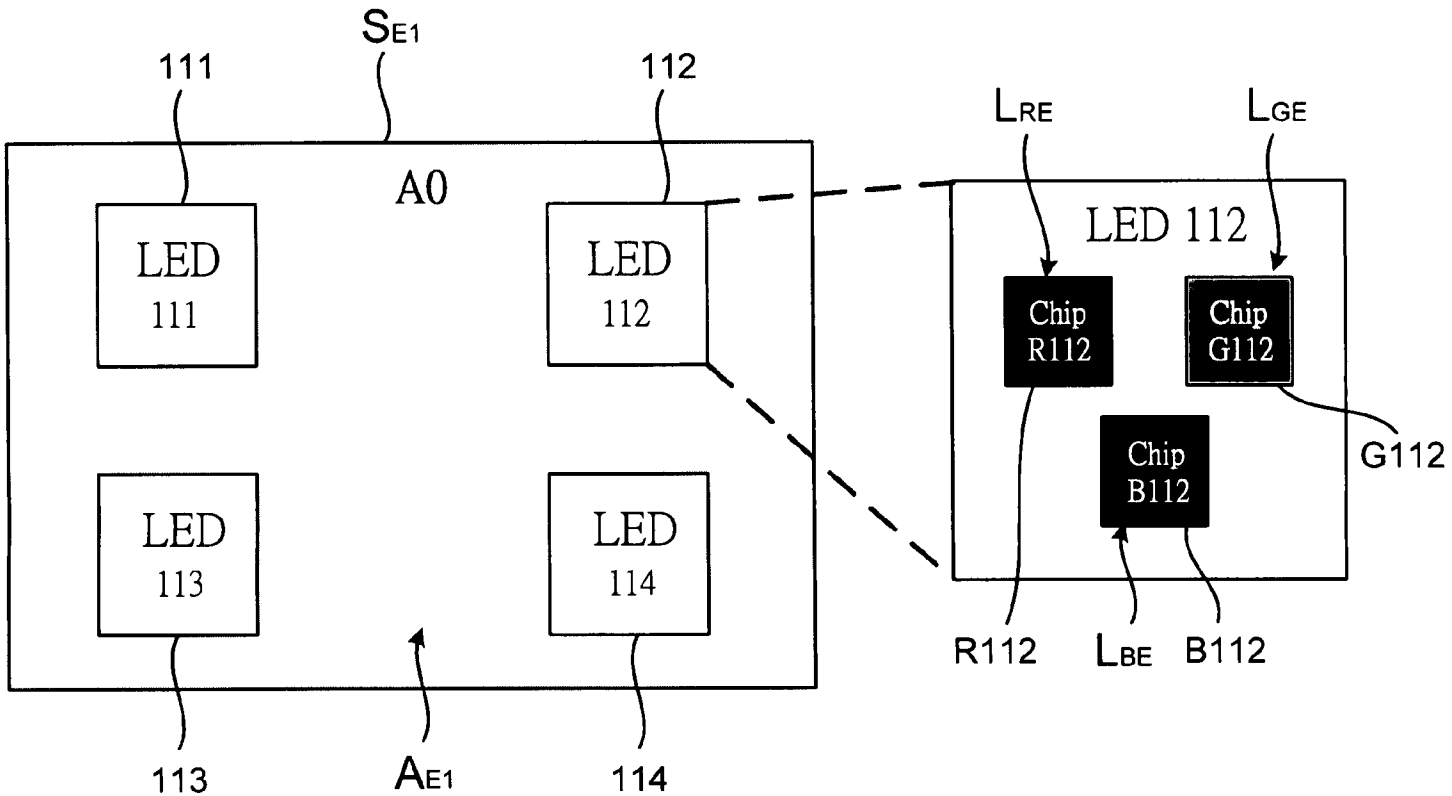
FIG. 3 shows schematically an edge zone portion of the LED backlight unit shown in FIG. 1.

Referring now to FIGS. 1-3, a backlight unit 100 is partially shown according to one embodiment of the present invention. The backlight unit 100 has a substrate 101, a first plurality of light emitting elements 151, 152, 153, . . . , a second plurality of light emitting elements 111, 112, 113, . . . , and an electronic controlling means 103 that is electrically coupled with the first plurality of light emitting elements 151, 152, 153, . . . and the second plurality of light emitting elements 111, 112, 113, . . . for controlling the light emitted from the first plurality of light emitting elements 151, 152, 153, . . . and the second plurality of light emitting elements 111, 112, 113, . . . , respectively.

In one embodiment, the substrate 101 has an edge zone 110 and a central zone 150 surrounded by the edge zone 110. In this exemplary embodiment, the central zone 150 has four segments, $S_{C1}$, $S_{C2}$, $S_{C3}$, and $S_{C4}$, where each segment $S_{Ci}$ has a corresponding surface area $A_{Ci}$, i=1, 2, 3, and 4. The surface areas $\{A_{Ci}\}$, i=1, 2, 3, and 4, can be same, as shown in FIG. 1, or different from each other. The edge zone 110 includes sixty segments $\{S_{Ej}\}$, where each segment $S_{Ej}$ has a corresponding surface area $A_{Ej}$, j=1, 2 . . . 60. The surface areas $\{A_{Ej}\}$, j=1, 2 . . . 60, can be same, as shown in FIG. 1, or different from each other. Moreover, $A_{Ej}$ can be same or different from $A_{Ci}$. The edge zone and the central zone, each having other numbers of segments, for example, with different configuration can also be utilized to practice the present invention. According the present invention, the number of segments of the edge zone 110 is greater than that of the central zone 150.

The first plurality of light emitting elements 151, 152, 153, . . . are positioned in the central zone 150 of the substrate 101. Specifically, each segments $S_{Ci}$ of the central zone 150 of the substrate 101 has one or more of the first plurality of light emitting elements 151, 152, 153, . . . Each of the first plurality of light emitting elements 151, 152, 153, . . . has at least a first LED chip capable of emitting light in a red color, a second LED chip capable of emitting light in a green color, and a third LED chip capable of emitting light in a blue color. Each LED chip associated with the first plurality of light emitting elements 151, 152, 153, . . . in the central zone 150 is characterized by a brightness degree $B_{kC}$ and an area $L_{kC}$, k=R, G, or B, corresponding to the red color light, the green color light, and the blue color light, respectively. In other words, brightness degree $B_{RC}$ is corresponding to the red color light, brightness degree $B_{GC}$ is corresponding to the green color light, and brightness degree $B_{BC}$ is corresponding to the blue color light, respectively. Similarly, area $L_{RC}$ is corresponding to the red color light, area $L_{GC}$ is corresponding to the green color light, and area $L_{BC}$ is corresponding to the blue color light, respectively.

As shown in FIG. 2, segment $S_{C1}$ of the central zone 150 of the substrate 101 includes four light emitting elements 151, 152, 153 and 154, indicated by LED 151, LED 152, LED 153 and LED 154, respectively. Each light emitting element has one or more LED chips. In this embodiment, for example, LED 152 has LED chips R152, G152 and B152 that are capable of emitting light in a red, green and blue color, respectively. Each LED chip R152, G152 or B152 has a corresponding area $L_{RC}$, $L_{GC}$ or $L_{BC}$.

The second plurality of light emitting elements 111, 112, 113, . . . , are positioned in the edge zone 110 of the substrate 101 such that each segment $S_{Ej}$ has one or more of the second plurality of light emitting elements. Each of the second plurality of light emitting elements 111, 112, 113 . . . includes at least three LED chips: a first LED chip capable of emitting light in a red color, a second LED chip capable of emitting light in a green color, and a third LED chip capable of emitting light in a blue color. Each LED chip associated with the second plurality of light emitting elements 111, 112, 113, . . . in the edge zone 110 is characterized by a brightness degree $B_{kE}$ and an area $L_{kE}$, k=R, G, or B, corresponding to the red color light, the green color light, and the blue color light, respectively. As shown in FIG. 3, segment $S_{E1}$ of the edge zone 110 of the substrate 101 includes four light emitting elements 111, 112, 113 and 114, indicated by LED 111, LED 112, LED 113 and LED 114, respectively. In this exemplary embodiment, for example, LED 112 has LED chips R112, G112 and B112 that are capable of emitting light in a red, green and blue color, respectively. Each LED chip R112, G112 or B112 has a corresponding area $L_{RE}$, $L_{GE}$ or $L_{BE}$.

According to the present invention, the areas, $L_{RC}$, $L_{GC}$ and $L_{BC}$, of the at least three LED chips of each of the first plurality of light emitting elements 151, 152, 153, . . . in the central zone 150 of the substrate 101 and these, $L_{RE}$, $L_{GE}$ and $L_{BE}$, of the at least three LED chips of each of the second plurality of light emitting elements 111, 112, 113, . . . in the edge zone 110 of the substrate 101 satisfy one of the following relationships:

$$L_{RE}<L_{RC},\ L_{GE}<L_{GC},\ \text{and}\ L_{BE}<L_{BC},$$

as shown in FIGS. 2 and 3.

Preferably, the number of light emitting elements in a segment is in the range of 1 to 6. However, segments having other numbers of light emitting elements can also be utilized to practice the present invention.

In operation, the brightness degrees, $B_{RC}$, $B_{GC}$ and $B_{BC}$, of the at least three LED chips of each of the first plurality of light emitting elements 151, 152, 153, . . . in the central zone 150 of the substrate 101 and these, $B_{RE}$, $B_{GE}$ and $B_{BE}$, of the at least three LED chips of each of the second plurality of light emitting elements 111, 112, 113, . . . in the edge zone 110 of the substrate 101, satisfy one of the following relationships:

$$B_{RE}<B_{RC},\ B_{GE}<B_{GC},\ \text{and}\ B_{BE}<B_{BC}.$$

Furthermore, the output power per unit area for these LED chips satisfies:

$$P_{RE}+P_{GE}+P_{BE}<P_{RC}+P_{GC}+P_{BC},$$

where $P_{RE}$, $P_{GE}$, $P_{BE}$, represent the output power per unit area corresponding to the red color light, the green color light, and the blue color light, respectively, of the second plurality of light emitting elements 111, 112, 113, . . . in the edge zone 110 of the substrate 101, and $P_{RC}$, $P_{GC}$, $P_{BC}$, represent the output power per unit area corresponding to the red color light, the green color light, and the blue color light, respectively, of the first plurality of light emitting elements 151, 152, 153, . . . in the central zone 150 of the substrate 101, respectively.

The total output power per unit area, $P_E$, by the second plurality of light emitting elements 111, 112, 113, . . . in the edge zone 110 of the substrate 101 is less than its counterpart, $P_C$, by the first plurality of light emitting elements 151, 152, 153, . . . in the central zone 150 of the substrate 101, i.e., $P_E<P_C$.

In another embodiment, the substrate has at least a first zone and a second zone. In operation, the first zone has a temperature $T_H$, and the second zone has a temperature $T_L$ that is less than $T_H$. The first zone and the second zone of the substrate may or may not be corresponding to the central zone 150 and the edge zone 110 of the substrate 101, as shown in FIG. 1, respectively.

The first plurality of light emitting elements and the second plurality of light emitting elements are positioned in the first zone, and the second zone of the substrate, respectively. Similar to the embodiment shown in FIGS. 1-3, each of the first plurality of light emitting elements and the second plurality of light emitting elements includes at least a first LED chip capable of emitting light in a red color, a second LED chip capable of emitting light in a green color, and a third LED chip capable of emitting light in a blue color.

In operation, the ratio of the output power for the red light to the total output power for the red, green and blue light in the second zone having the temperature $T_L$ is less than the ratio of the output power for the red light to the total output power of the red, green and blue light in the first zone having the temperature $T_H$, that is:

$$\frac{P_{RL}}{P_{RL}+P_{GL}+P_{BL}}<\frac{P_{RH}}{P_{RH}+P_{GH}+P_{BH}}$$

where $P_{RH}$, $P_{GH}$, $P_{BH}$, represent the output power per unit area corresponding to the red color light, the green color light, and the blue color light, respectively, of the first plurality of light emitting elements in the first zone having the temperature $T_H$, and $P_{RL}$, $P_{GL}$, $P_{BL}$, represent the output power per unit area corresponding to the red color light, the green color light, and the blue color light, respectively, of the second plurality of light emitting elements in the second zone having the temperature $T_L$, respectively.

Additionally, each of the first plurality of light emitting elements and the second plurality of light emitting elements comprises one or more or at least three LED chips, where each LED chip is capable of emitting light. In one embodiment, the one LED chip is capable of emitting light in a white color. In another embodiment, the at least three LED chips includes at least a first LED chip capable of emitting light in a red color, a second LED chip capable of emitting light in a green color, and a third LED chip capable of emitting light in a blue color. In alternative embodiment, the at least three LED chips may have at least one LED chip capable of emitting light in one color selected from the group of a red color, a blue color, a green color, a brown color, a yellow color, a pink color, a violet color, an indigo color, a reddish orange color, an orange color, a cyan color, a salmon pink color, a mauve color and a white color.

One aspect of the present invention provides a method for controlling brightness of the backlight units disclosed above.

The present invention, among other things, discloses an LED backlight unit includes a substrate having an edge zone and a central zone surrounded by the edge zone, a first plurality of light emitting elements positioned in the central zone of the substrate, a second plurality of light emitting elements positioned in the edge zone of the substrate, and an electronic controlling means for controlling the light emitted from the first plurality of light emitting elements and the second plurality of light emitting elements such that in operation, the output power per unit area by the second plurality of light emitting elements in the edge zone is less than that by the first plurality of light emitting elements in the central zone.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A backlight unit for use in a liquid crystal display, comprising:

(a) a substrate defining an edge zone and a central zone surrounded by the edge zone;

(b) a plurality of first light emitting elements positioned in the central zone of the substrate, each of the first light emitting element comprising a red light LED chip, a green light LED chip, and a blue light LED chip characterized by chip areas $L_{RC}$, $L_{GC}$, and $L_{BC}$, respectively; and (c) a plurality of second light emitting elements positioned in the edge zone of the substrate, each of the second light emitting element comprising a red light LED chip, a green light LED chip, and a blue light LED chip characterized by chip areas $L_{RE}$, $L_{GE}$, and $L_{BE}$, respectively, wherein at least one of the following relations is satisfied:

the chip areas $L_{RE}$ of the red light LED chip in each of the second light emitting elements is less than the chip areas $L_{RC}$ of the red light chip in each of the first light emitting elements;

the chip areas $L_{GE}$ of the green light LED chip in each of the second light emitting elements is less than the chip areas $L_{GC}$ of the green light chip in each of the first light emitting elements; and the chip areas $L_{BE}$ of the blue light chip in each of the second light emitting elements is less than the chip areas $L_{BC}$ of the blue light chip in each of the first light emitting elements.

2. The backlight unit of claim 1, further comprising an electronic controlling means for controlling the light emitted from the plurality of first light emitting elements and the plurality of second light emitting elements.

3. The backlight unit of claim 2, wherein the red light LED chip, the green light LED chip, and the blue light LED chip of each first light emitting elements are characterized by brightness degrees $B_{RC}$, $B_{GC}$, and $B_{BC}$, respectively, and the red light LED chip, the green light LED chip, and the blue light LED chip of each second light emitting elements are characterized by brightness degrees $B_{RE}$, $B_{GE}$, and $B_{BE}$, respectively, wherein the red light LED chips, the green light LED chips, and the blue light LED chips are operable for emitting red light, green light, and blue light, respectively, and wherein at least one of the following relations is satisfied:

the brightness degree $B_{RE}$ of the red light chip in each of the second light emitting elements is less than the brightness degree $B_{RC}$ of the red light chip in each of the first light emitting elements;

the brightness degree $B_{GE}$ of the green light chip in each of the second light emitting elements is less than the brightness degree $B_{GC}$ of the green light chip in each of the first light emitting elements; and the brightness degree $B_{BE}$ of the blue light chip in each of the second light emitting elements is less than the brightness degree $B_{BC}$ of the blue light chip in each of the first light emitting elements.

4. The backlight unit of claim 3, wherein the output powers per unit of chip areas of the red light LED chip, the green light LED chip, and the blue light LED chip of each of the first light emitting elements are characterized by $P_{RC}$, $P_{GC}$, and $P_{BC}$, respectively, and the output powers per unit of chip areas of the red light LED chip, the green light LED chip, and the blue light LED chip of each of the second light emitting elements are characterized by $P_{RE}$, $P_{GE}$, and $P_{BE}$, respectively, and wherein in operation, the sum $P_{RE}+P_{GE}+P_{BE}$ of the output powers per units of chip areas of the red light LED chip, the green light LED chip, and the blue light LED chip in the second light emitting elements is less than the sum $P_{RC}+P_{GC}+P_{BC}$ of the output powers per units of chip areas of the red light LED chip, the green light LED chip, and the blue light LED chip in the first light emitting elements.

5. The backlight unit of claim 2, wherein the red light LED chips, the green light LED chips, and the blue light LED chips are operable for emitting red light, green light, and blue light, respectively, and wherein in operation, one of the central zone and the edge zone has a temperature $T_H$, and the other of the central zone and the edge zone has a temperature $T_L$, and the temperature $T_H$ in the one of the central zone and the edge zone is greater than the temperature $T_L$ in the other of the central zone and the edge zone.

6. The backlight unit of claim 5, wherein the output powers per unit of the light-emitting chip areas of the red light LED chips, the green light LED chips, and the blue light LED chips in one of the central zone and the edge zone having the temperature $T_H$ are characterized by $P_{RH}$, $P_{GH}$, and $P_{BH}$, respectively, and the output powers per units of light-emitting chip areas of the red light LED chips, the green light LED chips, and the blue light LED chips in the other of the central zone and the edge zone having the temperature $T_L$ are characterized by $P_{RL}$, $P_{GL}$, and $P_{BL}$, respectively, and wherein in operation, the ratio $$\frac{P_{RL}}{P_{RL}+P_{GL}+P_{BL}}$$

of the output powers $P_{RL}$ per units of light-emitting chip areas of the red light LED chips in the one of the central zone and the edge zone to the sum $P_{RL}+P_{GL}+P_{BL}$ of the output powers per units of light-emitting chip areas of the one of the central zone and the edge zone is less than the ratio $$\frac{P_{RH}}{P_{RH}+P_{GH}+P_{BH}}$$

of the output powers $P_{RH}$ per units of light-emitting chip areas of the red light LED chips in the other of the central zone and the edge zone to the sum $P_{RH}+P_{GH}+P_{BH}$ of the output powers per units of light emitting chip areas of the other of the central zone and the edge zone.

7. The backlight unit of claim 1, wherein each of the edge and central zones has one or more segments.

8. The backlight unit of claim 7, wherein each of the one or more segments of the central zone has at least one first light emitting element.

9. The backlight unit of claim 7, wherein each of the one or more segments of the edge zone has at least one second light emitting element.

10. A backlight unit for use in a liquid crystal display, comprising:

(a) a substrate defining a first zone and a second zone, wherein in operation, the first zone has a temperature $T_H$, and the second zone has a temperature $T_L$ that is less than $T_H$;

(b) at least one first light emitting element positioned in the first zone of the substrate, comprising a red light LED chip, a green light LED chip, and a blue light LED chip, wherein the output powers per units of chip areas of the red light LED chip, the green light LED chip, and the blue light LED chip in the first zone are characterized by $P_{RH}$, $P_{GH}$, and $P_{BH}$, respectively;

(c) at least one second light emitting element positioned in the second zone of the substrate, comprising a red light LED chip, a green light LED chip, and a blue light LED chip, wherein the output powers per units of chip areas of the red light LED chip, the green light LED chip, and the blue light LED chip in the second zone are characterized by $P_{RL}$, $P_{GL}$, and $P_{BL}$, respectively; and (d) an electronic controlling means for controlling the light emitted from the at least one first light emitting element and the at least one second light emitting element, such that in operation, the ratio $$\frac{P_{RL}}{P_{RL}+P_{GL}+P_{BL}}$$

of the output powers $P_{RL}$ per units of chip areas of the red light LED chips in the second zone to the sum $P_{RL}+P_{GL}+P_{BL}$ of the output powers per units of chip areas in the second zone is less than the ratio $$\frac{P_{RH}}{P_{RH}+P_{GH}+P_{BH}}$$

of the output powers $P_{RH}$ per units of chip areas of the red light LED chips in the first zone to the sum $P_{RH}+P_{GH}+P_{BH}$ Of the output powers per units of chip areas in the first zone.

* * * * *